United States Patent [19]

Simanjuntak

[11] Patent Number: 4,813,816

[45] Date of Patent: Mar. 21, 1989

[54] DRIVEN PILE WITH TRANSVERSE BROADENING IN SITU

[76] Inventor: Johan H. Simanjuntak, Jalan Tanah Abang II/23, Jakarta, Indonesia

[21] Appl. No.: 114,116

[22] Filed: Oct. 27, 1987

Related U.S. Application Data

[63] Continuation-in-part of Ser. No. 934,620, Nov. 24, 1986, Pat. No. 4,733,994.

[30] Foreign Application Priority Data

Apr. 6, 1984 [ID] Indonesia ..... 10,005

[51] Int. Cl.[4] ..... E02D 5/74

[52] U.S. Cl. ..... 405/244; 405/232

[58] Field of Search ..... 405/244, 232, 253, 224, 405/237, 240; 52/159, 160, 98; 411/21; 175/5-7

[56] References Cited

U.S. PATENT DOCUMENTS

| | | | |
|---|---|---|---|
| 1,026,402 | 5/1912 | Marshall et al. | 52/159 |
| 1,762,341 | 6/1930 | McPherson | 405/244 X |
| 2,198,964 | 4/1940 | Goodyear | 403/12 |
| 2,468,729 | 5/1949 | Black | 405/244 X |
| 2,812,200 | 11/1957 | Yeargan | 403/12 |
| 2,878,649 | 3/1959 | Jacobs | 175/9 X |
| 2,881,591 | 4/1959 | Reeve | 405/224 |
| 3,113,436 | 12/1963 | Nalen . | |
| 3,312,138 | 4/1967 | Cumming | 411/21 |
| 3,526,069 | 1/1970 | Deike | 52/160 |
| 3,628,338 | 12/1971 | Stepanich | 405/253 |
| 3,751,931 | 8/1973 | Merjan . | |
| 4,091,882 | 5/1978 | Hashimoto | 52/160 X |

FOREIGN PATENT DOCUMENTS

| | | | |
|---|---|---|---|
| 97525 | 1/1984 | European Pat. Off. | 405/244 |
| 0157033 | 10/1985 | European Pat. Off. | 405/244 |
| 1210385 | 10/1969 | Fed. Rep. of Germany . | |
| 2405238 | 8/1975 | Fed. Rep. of Germany | 52/159 |
| 0142925 | 11/1981 | Japan | 405/244 |
| 761663 | 9/1980 | U.S.S.R. | 405/244 |
| 815125 | 3/1981 | U.S.S.R. | 405/244 |
| 388242 | 2/1933 | United Kingdom . | |
| 525548 | 8/1940 | United Kingdom . | |
| 628795 | 9/1949 | United Kingdom . | |
| 835804 | 6/1958 | United Kingdom . | |
| 1009399 | 11/1965 | United Kingdom | 411/21 |
| 1286726 | 8/1972 | United Kingdom . | |
| 1315609 | 5/1973 | United Kingdom . | |
| 1535740 | 12/1978 | United Kingdom . | |

*Primary Examiner*—Dennis L. Taylor

*Attorney, Agent, or Firm*—Christie, Parker & Hale

[57] ABSTRACT

A pile assembly for supporting a structure after being driven into a soil stratum comprises a pile body having a hollow interior. Two or more slots extend through the pile body at two or more different elevations. A steel plate is positioned within each slot. When driven into the ground, a mandrel is inserted into the pile body and used to push an actuator downwardly which, in turn, forces the steel plates outwardly into the soil stratum.

14 Claims, 8 Drawing Sheets

Fig. 5
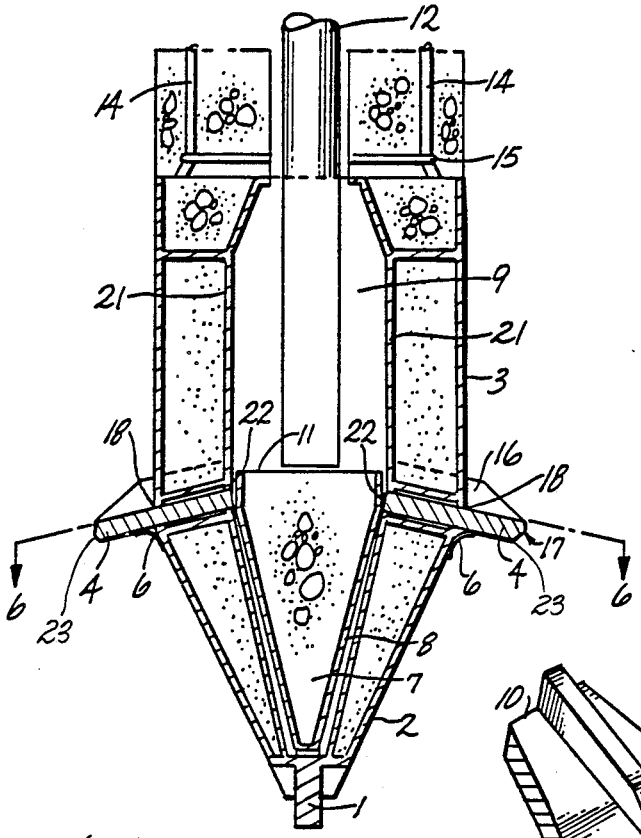
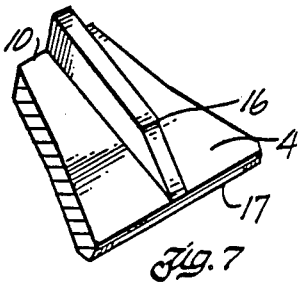
Fig. 7
Fig. 6
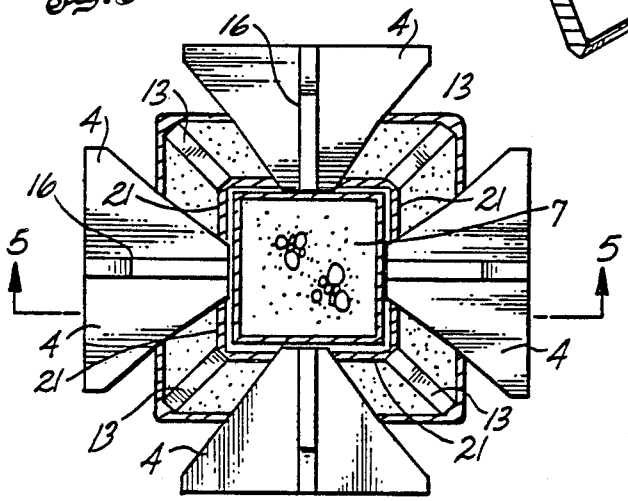

Fig. 18
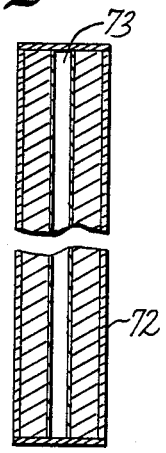
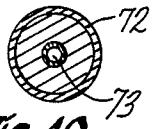
Fig. 19
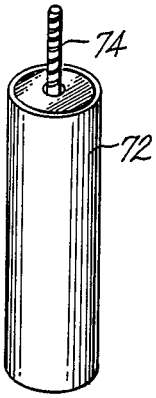
Fig. 20
Fig. 11
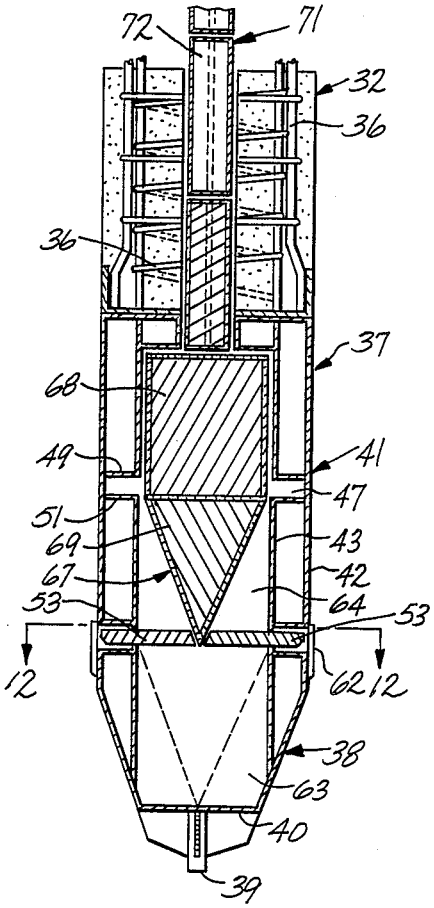
Fig. 12
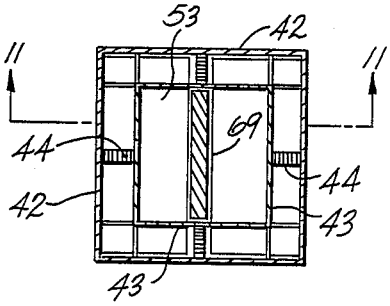

DRIVEN PILE WITH TRANSVERSE BROADENING IN SITU

This is a continuation-in-part of application Ser. No. 06/934,620, filed Nov. 24, 1986, now U.S. Pat. No. 4,733,994.

BACKGROUND OF THE INVENTION

1. Field of the Invention

This invention relates to piles, which may be square or round in cross-section, made of pre-case concrete or steel.

2. Description of Related Art

It is well understood that the overall bearing capacity of a pile is determined by two factors viz, the bearing capacity of the soil in the area in which the pile is to be driven and the structural strength of the pile itself. Generally, of these two limitations, the bearing capacity of soil is a decisive factor. The problem now is how to increase the total soil bearing capacity relative to the pile or to improve the interactions between the soil layers and the pile body to such an extent that the total bearing capacity becomes higher. The bearing capacity of the soil relative to the pile depends on two forces; these are the friction forces acting against the body of the pile and the end bearing forces.

The broader the pile foot, the greater the end resistance of the pile itself. However, a pre-cast concrete pile with an enlarged foot cannot be easily driven, due to the greater resistance in penetrating the soil layer.

SUMMARY OF THE INVENTION

According to the present invention, there is provided a pile or pile assembly formed of pre-cast concrete or of steel or other suitable material. The pile is provided at least at one position along its length with substantially transversely extending steel or other suitable metal plates. During driving of the pile, the plates are located wholly within the pile but can be caused to protrude from the sides of the pile upon completion of driving of the pile to increase or improve the bearing capacity of the pile. When the pile tip reaches the firm soil strata, driving is discontinued. The cross-sectional area of the pile foot or toe, or another part of the pile, is then increased, preferably, horizontally, in such a way that the pile will have a wider contact base, which increases the soil bearing capacity of the pile.

When this invention is applied to the toe of a pile, it has three functions, each of which positively complement one another to increase the quality and performance of the pile. Firstly, the invention reinforces the pile tip for penetrating hard layers. Secondly, pre-cast concrete pile tips produced manually on site in wooden molds are often asymmetric in form, and the resulting pile has a tendency to deviate from its original path during driving. Using the present invention, the pile can be driven in a straight direction without deviation. A steel pile toe manufactured according to the present invention with precision in a standard form substantially eliminates any deviation.

The third and major function of the toe of the present invention is to provide a broader base for the pile, which increases the bearing capacity of the pile as a whole.

In one preferred embodiment of the invention, steel discs or plates are located inside the toe at the same elevation, preferably at the line between the vertical surface of the pile and the tapered surface of the pile tip. However, if desired, the steel plates can be placed either at the lower part of the pile or anywhere along the pile body. In another preferred embodiment of the invention, two or more steel discs or plates are located inside the toe in a staggered arrangement, i.e., at different elevations.

The toe is preferably made of steel and the steel plates are preferably located generally horizontally within the toe. The steel plates can be pushed out through apertures or slots in the toe to penetrate horizontally into the soil horizontally after driving of the pile is complete.

The plates are pushed out immediately after driving is completed, when the pile tip has reached and arrived at the firm soil layer. The plates are pushed out from the center of the toe by friction forces produced at the inner side of the plates from the downward motion of a conical or pyramid-shaped actuator member in the center of the pile. However, a part of the steel plates remains inside the apertures or slots.

During assembly of the pile and toe, and during transportation and driving of the pile, the steel plates should always be retained wholly inside the body. Small steel retaining bars or steel plates placed across the outer ends of the apertures prevent the plates from sliding out. The lower end of each bar or steel plate is welded to the outer surface of the pile toe.

BRIEF DESCRIPTION OF THE DRAWINGS

An embodiment of the invention will now be described, by way of an example, with reference to the accompanying drawings, in which:

FIG. 5 is a longitudinal section through the toe of the pile of FIG. 2 with the plates moved outwardly, the section being taken along the line V—V of FIG. 6;

FIG. 6 is a transverse section through the toe of the pile of FIG. 2 taken along the line VI—VI of FIG. 5;

FIG. 7 is a perspective view of a steel plate for use in the of FIGS. 1–6.

FIG. 11 is a longitudinal section through the tow of the pile of FIG. 9 with the plates in their retracted position taken along the line XI—XI of FIG. 12;

FIG. 12 is a transverse section through the tow of the pile of FIG. 9 with the plates in their retracted position taken along the line XII—XII of FIG. 11;

FIG. 18 is a longitudinal section of a segment of a preferred mandrel;

FIG. 19 is a transverse section of the mandrel segment shown in FIG. 18; and

FIG. 20 is a perspective view of the bottom mandrel segment of a preferred mandrel.

DETAILED DESCRIPTION OF THE PREFERRED EMBODIMENT

Figure 1:
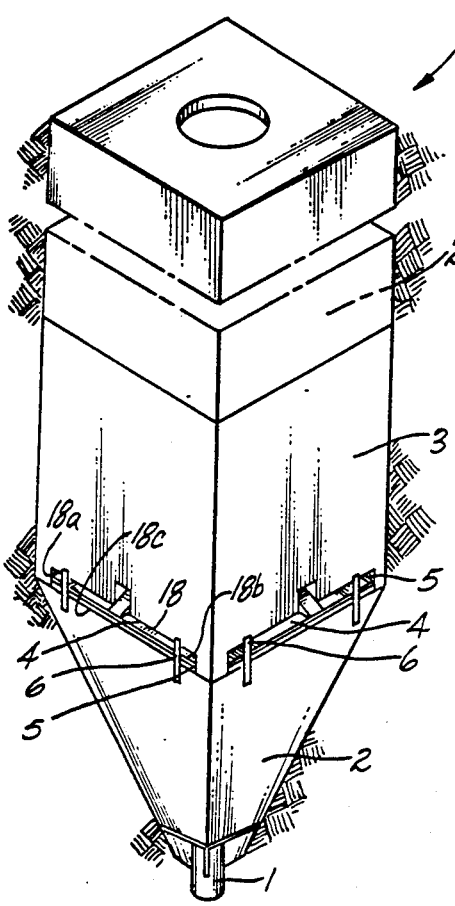
FIG. 1 is a perspective view of a pile according to the present invention in a form to be used during driving with in a retracted position.
Figure 2:
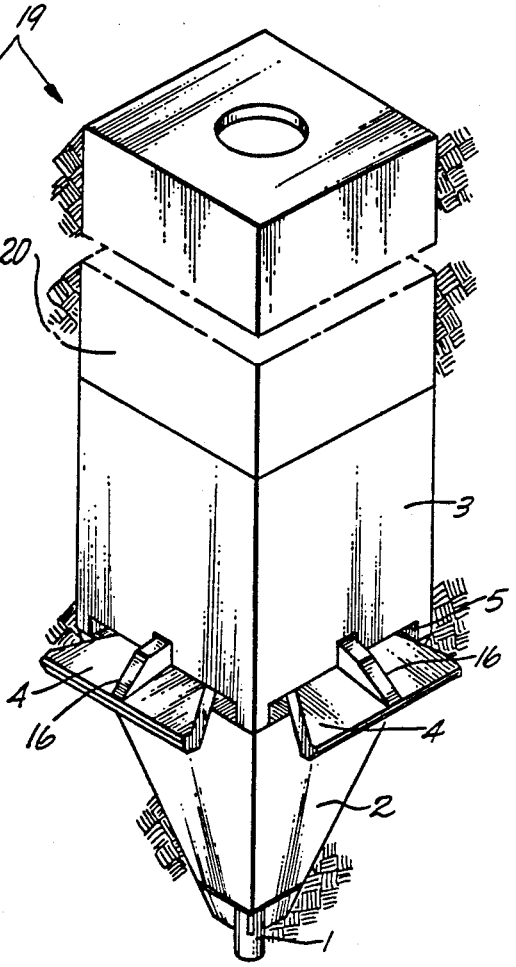
FIG. 2 is a perspective view of the pile of FIG. 1 with the plates moved outwardly.

A preferred embodiment of the invention is shown in the drawings, FIG. 1 and FIG. 2, and comprises a column in the form of a pile 19 has a hollow rectangular body portion 20 formed of pre-cast concrete and defining the pile for supporting a building or other structure. The pile may also be formed of steel and may have a circular cross-section or any other suitable cross-sectional shape. Provided at the bottom end of the pile is a toe 3 formed of steel, the upper part of which has a cross-section corresponding to that of the body portion 20 and the lower part 2 of which has the shape of an inverted pyramid for guiding the pile into the soil. In the case where the pile is circular in cross-section, the lower part 2 preferably has the shape of an inverted cone. Provided at the apex of the lower part 2 is a tip 1 for penetrating the soil.

Apertures in the form of slots 5 are provided, preferably at the transition between the upper part of the toe 3 and the lower part 2, for positioning and guiding generally transversely oriented steel discs or, as shown in FIG. 7, trapezoidal plates 4, to be described below. The slots 5 have edges 18, 18*a*, 18*b*, and 18*c* formed in the wall of the body portion defining each slot. The slots 5 extend in a direction substantially perpendicular to the direction in which the pile 19 is to be driven.

During assembly, transportation and driving of the pile 19, the plates 4 are retained wholly within the toe 3 by retainer bars 6. The retainer bars extend generally upwardly across the respective outer ends of the slots 5. The bars 6 comprise steel bars or steel plates which at their bottom end are welded to the lower part 2 of the toe 3 and extend upwardly toward the upper part of the toe. The number, size, e.g., width, length or thickness, of the retaining bars 6 may vary as desired. During downward movement of the pile, these retainer bars 6 are pressed inwardly by the surrounding soil which keeps the steel plates 4 in position inside the toe 3.

Figure 3:
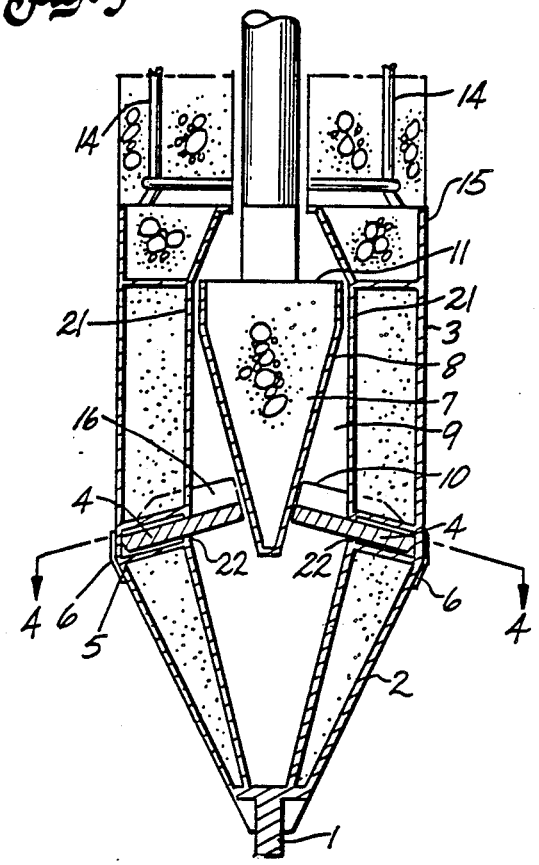
FIG. 3 longitudinal section through the toe of the pile of FIG. 1 with the plates retracted, the section being taken along the line III—III of FIG. 4.
Figure 4:
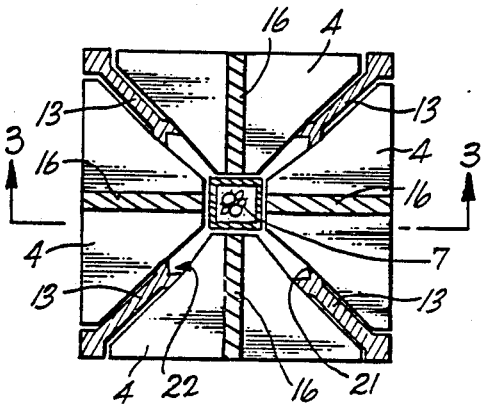
FIG. 4 is a transverse section through the toe of the pile of FIG. 1 taken along the line IV—IV of FIG. 3.

The pile toe 3 is anchored at the body portion 20 of the pile by steel anchors 14 (FIG. 3) which are welded to a steel plate 15 of the pile toe 3. The pile toe 3 is provided with reinforcing ribs 13 (FIG. 4).

The reinforcing ribs 13 provide support between the outer structure of pile toe 3 and an internal frame 21 of the pile toe. The space between the outer structure and the internal frame may be filled with concrete. The internal frame guides and retains an actuator member 7 for pushing the plates 4 outwardly, to be described below. The transverse cross-sectional shape of the internal frame preferably follows, on a longitudinal axis, the transverse cross-sectional shape of the outer structure of pile toe 3. Generally horizontal slots 22 for accommodating the plates 4 are provided, preferably at the transition between upper and lower parts of the internal frame. A vertical slot is formed midway in each respective slot 22 and substantially perpendicular thereto extending upwardly from the slot 22.

The plates 4 are preferably generally trapezoidal-shaped or dove tailed with the long parallel side or outer edge 17 being upwardly tapered so that a bevel is provided on the top edge (FIG. 7). The trapezoidally-shaped plates are for use preferably with a pyramid-shaped pile toe. The upper surface of each plate (FIG. 7) is provided with an upwardly extending reinforcing rib 16 whose inner end 10 contacts the surface of actuator member 7. As the rib 16 approaches the outer edge 17 of the plate, the upper surface of the rib is beveled downwardly to meet the outer edge 17. It is understood that plates 4 without such a reinforcing rib 16 may be used as desired.

Figure 8:
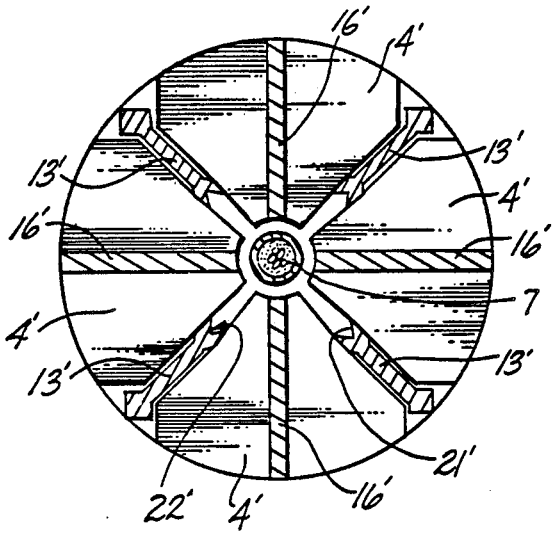
FIG. 8 is a transverse section through the toe of a pile, similar to that of FIG. 4, for an alternate embodiment where the toe of the pile and the actuator all have a conical outer shape.

An actuator member 7 (FIG. 3) is located within the toe 3, interior to the internal frame 21, and is formed from a steel plate 8 and whose interior is filled with concrete. The member 7 is in the form of an inverted pyramid and the sides of the member 7 contact the inner ends of the plates 4. The pyramid-shaped actuator member is provided in the center of the toe, installed with the apex facing downwardly. The actuator member operates as a piston pressed down by an impact mandrel driven from the top of the pile. When the member is driven down by the mandrel, the member forces the plates to move horizontally through the apertures and to penetrate into the soil, thereby increasing the bearing capacity of the pile.

Where the toe is conically shaped, the actuator member is also preferably conically shaped. The pile toe with a conical configuration is shown in FIG. 8, which is a view of a pile toe similar to that of FIG. 4. The shapes of the elements of FIG. 4 have been changed to conform to a pile toe of circular cross-section and are identified with the same reference numerals as used in FIG. 4 but with primes added. The function of the elements is substantially the same as that described with respect to the pile toe of FIG. 4.

The application of the invention will now be described. The pile is driven into the ground until it has penetrated into the firm soil strata. The driving of the pile is terminated and the mandrel is inserted into the pile from its upper end. The mandrel contacts the upper end 11 of the actuator member 7 and is then driven downwardly against the actuator member 7 to move the actuator member 7 downwardly. The actuator member 7 acts on the plates 4 to cause them to move outwardly through the slots 5.

During the initial movement of the plates 4, the steel retaining bars or steel plates 6 are deformed outwardly. As shown in FIG. 6, the deformed bars 6 push the plates 4 upwardly so that the latter are pressed against the upper edge 18 of the apertures 5. A upward pressure is also produced as the plates 4 penetrate into the strata surrounding the toe 3 and, due to the tapered outer edge of each plate 4.

The plates 4 remain within the slots 5 after being pushed outwardly by the actuator member 7. The inner part 9 of the toe 3 is hollow to allow movement of the mandrel. When the plates 4 have been pushed outwardly, the mandrel is removed from the pile and the interior of the body portion of the pile and the inner part 9 of the toe 3 are filled with concrete to strengthen the pile structure. This filling is carried out by passing concrete into the pile from its upper end.

The plates 4, when pushed outwardly, increase the contact area of the pile within the strata into which it has been driven. Thus, the bearing capacity of the pile is increased. The number of plates 4 is preferably a minimum of two and should be symmetrically disposed.

It will be appreciated that the plates 4 instead of being located within the toe 3 may be located at any other desired location or locations along the pile. In addition, the plates 4 may be staggered along the length of the pile rather than all at the same elevation.

For example, FIGS. 9–17 shows another preferred embodiment of the invention in which the pile comprises two staggered pairs of plates. In this embodiment, the pile or pile assembly 30 comprises a pile body 31 having an elongated upper columnar section or column 32 and a lower toe section or toe 33. The column 32 has a generally square transverse cross-sectional external configuration and a generally circular transverse cross-sectional internal configuration. The hollow interior of the column 32 forms a generally cylindrical passageway. It is understood that the exterior and interior transverse cross-sectional configurations of the column 32 may vary as desired. The column 32 may be made of any suitable material. Prestressed concrete is presently preferred.

The toe 33 is preferably made of steel and is fixedly attached to the bottom of the column 32 by any suitable means. For example, in the embodiment shown, the column 32 is made of concrete, and the toe is attached to the column by means of a metal anchor 36 which is embedded in the concrete of the column 32.

The toe 33 comprises an upper section 37 and a lower section 37. The upper section has generally the same external transverse cross-sectional configuration as that of the column 32, e.g., square. The lower section 38 has an external configuration generally of an inverted pyramid. A point or tip 39 protrudes from the lowest point of the toe 33 for initially penetrating the soil stratum.

The toe 33 is formed by four side walls 41 and a bottom wall 40. Each side wall 41 comprises an exterior wall 42 and an interior wall 43 spaced apart inwardly from each exterior wall 42.

The interior walls 43 form an internal frame within the toe 33. In the upper section 37 of the toe 33, the exterior and interior walls 42 and 43 are generally vertical. In the lower section 38 of the toe 33, the exterior wall 42 extends downwardly and inwardly, converging toward a point. The interior walls 43, however, remain vertical and, as shown in FIG. 11, meet the exterior walls 42 at a position slightly above the bottom wall 40.

The interior and exterior walls 43 and 42 are about the same width. The lateral edges of the exterior wall 42 and interior wall 43 of a side wall 41 engage and are fixedly attached, e.g., welded, to the exterior walls 41 of the adjacent side walls 41. The interior wall 43 of a side wall 41 intersects and is fixedly joined with the interior walls 43 of the adjacent side walls 41.

Each side wall 41 further comprises a reinforcing rib 44 which extends vertically between the interior wall 43 and the exterior wall 42 at about the midpoint of the side wall 41.

The interior wall 43 defines an interior cavity within the toe having a generally square transverse cross-section. Two pairs of slots extend through the side walls 41 of the toe 33. A pair of upper slots 47 extend generally horizontally through two opposing side walls 41 at a first elevation, and the pair of lower slots 40 extend generally horizontally through the other two opposing side walls 41 at a second elevation lower than the first elevation.

The slots 47 and 48 are generally rectangular in shape and are defined at their inner and outer ends by generally rectangular interior and exterior openings in the interior wall 43 and exterior wall 42, respectively. The slots 47 and 48 are further defined by a generally horizontal upper wall 49 and a lower wall 51, which extend between the interior and exterior walls 43 and 42 of the side walls 41. The sides of the slots 47 and 48 are defined by the interior walls 43 of the adjacent side walls 41. The reinforcing ribs 44 divide the slots 47 and 48 into two generally equal sections.

Figure 9:
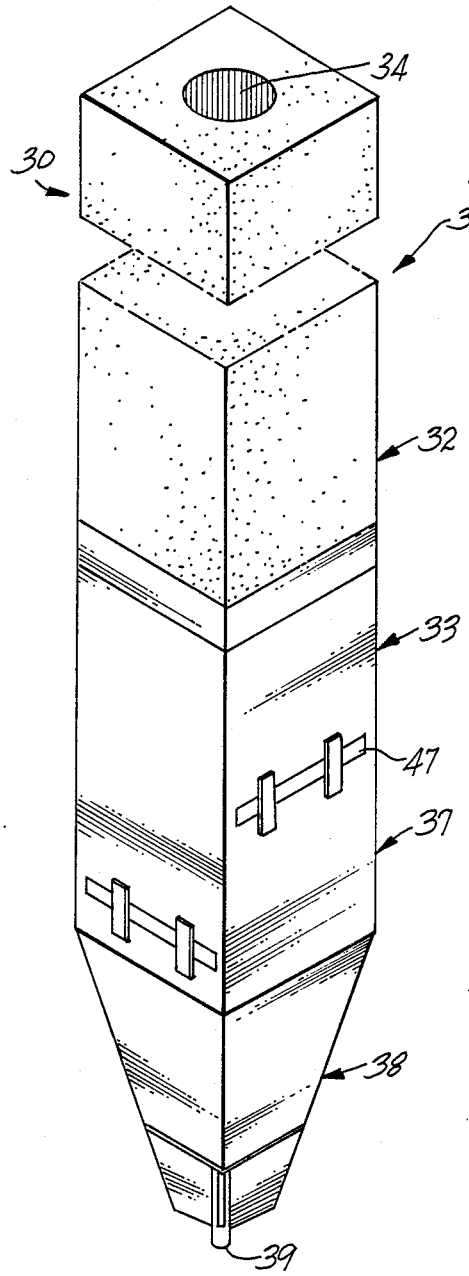
FIG. 9 is a perspective view of another pile in accordance with the invention in which the plates are in a staggered arrangement, shown with the plates in their retracted position.
Figure 10:
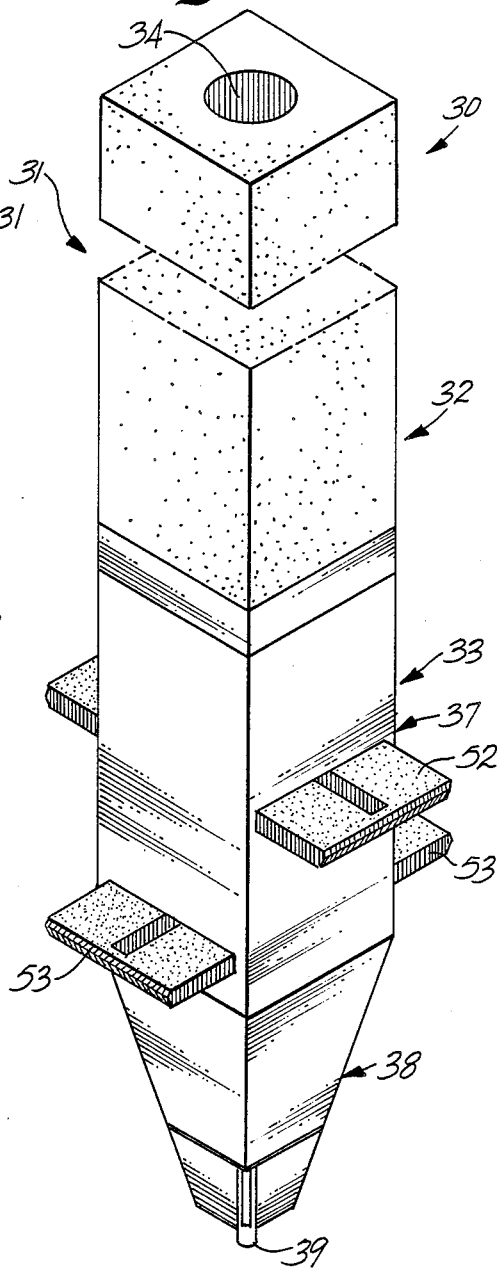
FIG. 10 is a perspective view of the pile of FIG. 9 whown with the plates in their extended position.
Figure 13:
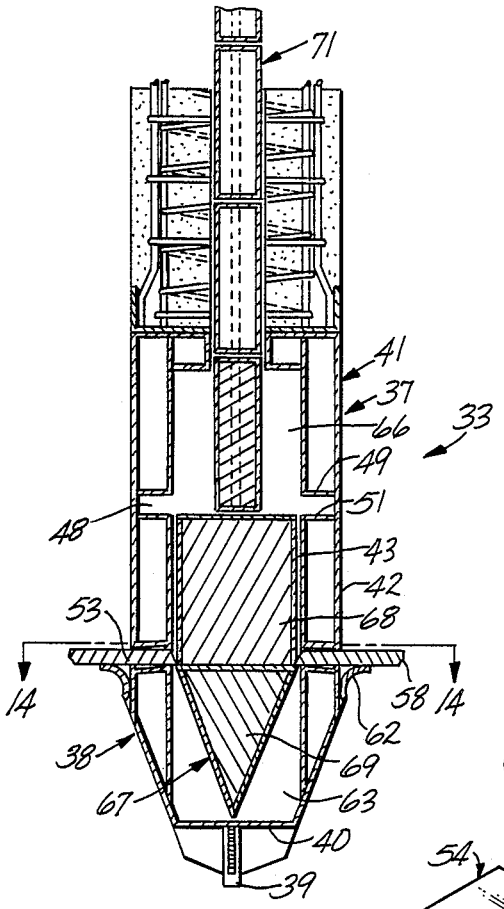
FIG. 13 is a longitudinal section through the toe of the pile of FIG. 9 with the plates in their extended position taken along the line XIII—XIII of FIG. 14.
Figure 16:
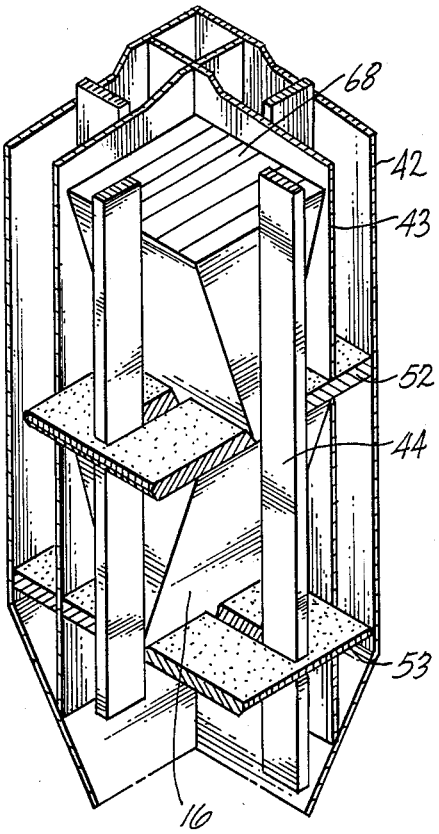
FIG. 16 is a perspective cut-away view of the tow of the pile of FIG. 9 with the plates in their retracted position.
Figure 17:
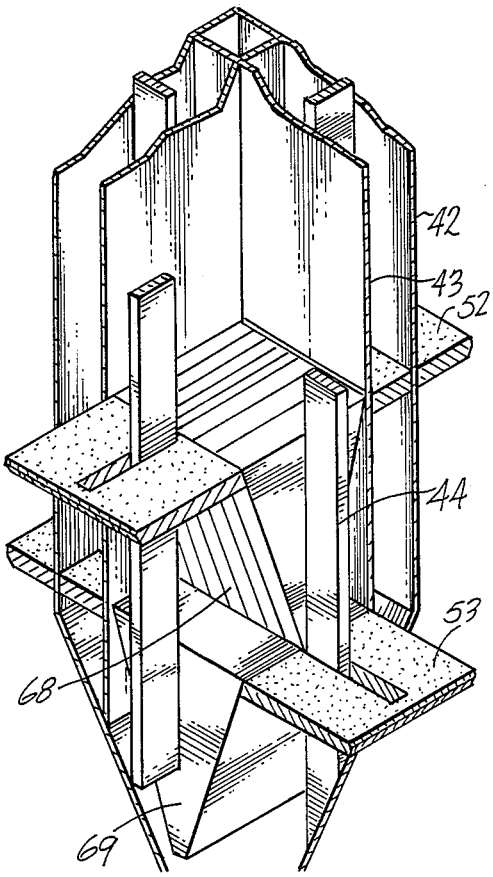
FIG. 17 is a perspective cut-away view of the toe of the pile of FIG. 9 with the plates in their extended position.

Upper and lower movable steel plates 52 and 53 are disposed the upper and lower slots 47 and 48. The upper and lower plates 52 and 53 are afforded movement from a retracted position as shown in FIGS. 9, 11 and 16, wherein the upper and lower plates 52 and 53 are entirely contained within the toe 33 to an extended position as shown in FIGS. 10, 13 and 17 wherein the plates 52 and 53 protrude from the side walls 41 of the toe 33.

Figure 15:
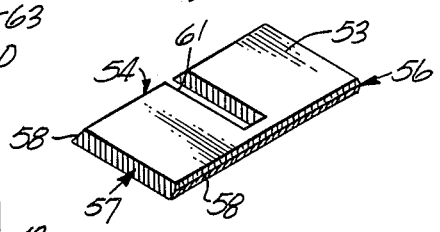
FIG. 15 is a perspective view of a steel plate for use in the embodiment of FIGS. 9–17.
Figure 14:
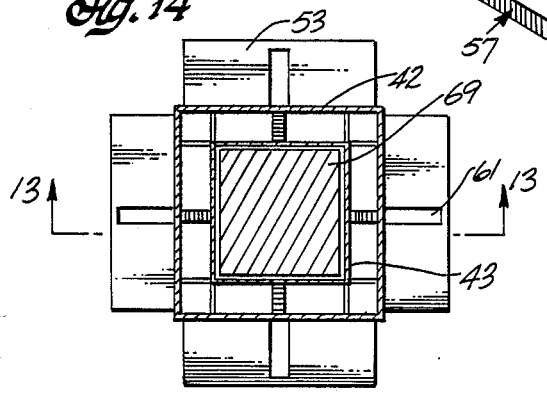
FIG. 14 is a transverse section through the tow of the pile of FIG. 9 with the plates in their extended position the line XIV—XIV of FIG. 13.

With reference to FIG. 15, the upper and lower plates 52 and 53 are generally the same, each being generally rectangular in shape and having an inner edge 54, an outer edge 56 and two side edges 57. As shown in FIGS. 11 and 13, the outer edge 56 comprises an outer beveled 58 surface, which extends downwardly and inwardly, i.e., toward the center of the toe.

The inner edge 54 comprises a tapered surface 59 which also extends downwardly and inwardly. When the plates 52 and 53 are in their retracted position, as shown in FIG. 11, the inner edges 54 of adjacent plates, e.g., the lower plates 53, form a "V"-shaped groove.

The plates 52 and 53 further comprise a center channel 61 which extends from about the center of the inner edge 52 generally parallel which the side edges 57 to a position spaced-apart from the outer edge 56. The plates 52 and 53 are mounted in the slots 47 and 48 so that the reinforcing ribs 44 of the side walls 41 are disposed in the channels 61 of the plates 52 and 53.

Deformable metal retaining bars 62 are fixedly attached, e.g., welded, to the outer surface of the side walls 41 at positions below the slots 47 and 48 and extend upwardly across the exterior openings of the slots 47 and 48. The retaining bars 62 retain the plates 52 and 53 in their retracted position as the pile assembly 30 is driven into a soil stratum.

In their retracted positions, the upper and lower plates 52 and 53 divide the interior cavity of the toe 33 into three chambers, a lower chamber 63 below the lower plates 53, a middle chamber 64 between the upperplates 52 and lower plates 53 and an upper chamber 66 above the upper plates 52.

An actuator 67 is disposed within the interior cavity 46 of the toe. The actuator 67 comprises generally similar upper and lower wedges 68 and 69. Each wedge 68 and 69 is generally "V" shaped and comprises a generally horizontal square upper surface, a pair of triangular generally vertical end surfaces and a pair of generally rectangular side surfaces which extend downwardly and inwardly to a bottom edge.

The width of the wedges 68 and 69 is about the same as the horizontal width of the plates 52 and 53, i.e., the distance between the side edges 57 of the plates 52 and 53. The wedges 68 and 69 are mounted in coaxial relation to each other, with the bottom edge of the upper wedge 68 being oriented at right angles to the bottom edge of the lower wedge 69.

The actuator 67 is movable from an upper position as shown in FIGS. 11 and 16 to a lower position as shown in FIGS. 13 and 17. In its upper position, the lower wedge 69 is positioned within the middle chamber 64 of the interior of the toe with its bottom edge positioned within the V-shaped groove formed by the inner edges 54 of the lower plates 53. The upper surface of the lower wedge 69 is at about the same elevation as the horizontal lower walls 51 which define the lower surface of the upper slots 47. In their retracted position, the upper plates 52 lie within the upper slots 47 and extend over the upper surface of the lower wedge 69.

Like the lower plates 53, the inner edges 54 of the upper plates 52 form a V-shaped groove when the upper plates 52 are in their retracted position. The upper wedge 58 is mounted in the upper chamber 66 of the toe 33 with its bottom edge extending into the V-shaped groove formed by the inner edges 54 of the upper plates 52 and engages the upper surface of the lower wedge 69.

It is understood that the activator 67 can be a single unit with the upper wedge 68 and lower wedge 69 fixedly joined together along the bottom edge of the upper wedge 68. Alternatively, the upper wedge 68 and lower wedge 69 may be separate from each other.

In practice, the pile assembly 30 is driven into a soil stratum to a desired elevation. A mandrel 71 is then inserted into the hollow interior of the pile body 31 and engages the top of the upper wedge. The mandrel 71 may be a single long unit or, more preferably is segmented as shown in FIGS. 11 and 13.

With reference to FIGS. 18–20, a presently preferred mandrel 71 comprises cylindrical segments 72 having an axial bore 73 through which a steel cable 74 extends. The cable 74 is fixedly attached to the bottom mandrel segment 72 which is the inserted first into the pile body 32. The cable 74 acts as a centering guide for the remaining segments 72 of the mandrel 71.

Once the mandrel has been inserted, it is forced downwardly causing the upper and lower wedges 68 and 69 to move downwardly to their lower positions. As the upper and lower wedges 68 and 69 move toward their lower positions, the upper and lower plates 52 and 53 are forced laterally outwardly, deforming the metal retaining bars 62, i.e., bending the upper ends of the retaining bars 62 outwardly as shown in FIG. 13. As the retaining bars 62 are deformed, they exert an upward pressure on the plates 52 and 53 which maintain the upper surface of the plates 52 and 53 against the upper edge of the slots 47 and 48. As the plates 52 and 53 move into the surrounding soil, the beveled surface 58 at the outer edge 56 of the plates 52 and 57 engages the soil which imparts additional upward pressure on the plates 52 and 53.

In the above-described embodiment, extendable plates are provided at two different elevations. It is understood that the plates may be provided at three or more different elevations as desired. Moreover, the number of plates at each elevation may vary as desired.

Depending upon the configuration of the pile body and the number of plates at each elevation, the configuration of the wedges of the actuator may vary. For example, in an embodiment comprising four plates at each of two different elevations, the actuator may comprise upper and lower wedges wherein each wedge had an inverted pyramidal shape. Alternatively, upper and lower wedges, each having an inverted conical shape may be suitable. If extendable plates are located at three or more different elevations, the actuator would comprise three or more such wedges.

Accordingly, the above-described embodiments of the invention should only be considered to be preferred embodiments which are illustrative of the inventive concepts. The scope of the invention is not to be restricted to such embodiments. Various and numerous other arrangements may be devised by one skilled in the art without departing from the spirit and scope of the invention.

What is claimed is:

1. An elongated pile assembly for supporting a structure after the pile assembly is driven into a soil stratum, the assembly comprising:

an elongated pile body having upper and lower ends, a hollow interior and an exterior surface;

at least one first slot extending through the pile body from the hollow interior to the exterior surface of the pile body at a first elevation;

at least one second slot extending through the pile body from the hollow interior to the exterior surface of the pile body at a second elevation different from the first elevation;

a plate having inner and outer ends positioned within each of the first and second slots, each of said plates being moveable from a retracted position wherein the plate does not protrude from the pile body and an extended position wherein the outer end of the plate protrudes from the pile body; and an actuator positioned within the hollow interior of the pile body comprising a first wedge for engaging the inner edge of each plate in each first slot and a second wedge for engaging the inner edge of each plate in each second slot, said actuator being moveable from an upper position to a lower position wherein movement of the actuator from its upper to its lower position causes each plate to move from its retracted position to its extended position; and means for moving the actuator from its upper position to its lower position.

2. An elongated pile assembly as claimed in claim 1 further comprising means for maintaining each plate in its retracted position during driving of the pile assembly into a soil stratum.

3. An elongated pile assembly as claimed in claim 2 wherein the means for maintaining each plate in its retracted position during driving of the pile assembly into a soil stratum comprises:

at least one deformable retainer bar fixedly attached to the exterior surface of the pile body at a position below each slot, said retainer bar extending upwardly across the exterior opening of the slot to thereby retain the plate within the slot during driving of the pile assembly into a soil stratum.

4. An elongated pile assembly as claimed in claim 3 wherein said retainer bar is deformed when the plate moves from its retracted position to its extended position and wherein in its deformed state, said retainer bar, exerts an upward pressure on the plate to maintain the plate against the upper edge of the exterior opening of the slot.

5. An elongated pile assembly as claimed in claim 1 wherein the outer edge of each plate comprises a tapered edge for urging the plate upwardly when the plate moves through a soil stratum from its retracted position to its extended position.

6. An elongated pile assembly as claimed in claim 1 wherein the pile assembly comprises two first slots extending in opposite directions through the pile body at the first elevation and two second slots extending in opposite directions thorugh the pile body at the second elevation.

7. An elongated pile assembly as claimed in claim 1 wherein the directions of the first slots are normal to the directions of the second slots.

8. A pile assembly for supporting a structure after the pile assembly is driven into a soil stratum, the assembly comprising:

a reinforced concrete pile element having a rectangular transverse cross-section and comprising upper and lower ends and a hollow interior which defines a passageway for a mandrel;

a toe mounted on the lower end of the pile element, the toe comprising four side walls defining an upper section having a generally uniform transverse cross-section about the same as the transverse cross-section of the pile element and an inverted pyramidally-shaped bottom section, said toe further comprising a hollow interior;

a pair of upper slots symmetrically positioned through the side walls of the toe at a first elevation;

a pair of lower slots symmetrically positioned through the side wall of the toe at a second elevation lower than the first elevation;

upper and lower plates positioned within the upper and lower slots respectively, each plate having inner and outer edges, said plates being movable from a retracted position wherein the plates do not protrude from the toe to an extended position wherein at least the outer edge of the plates protrudes from the toe; and an actuator disposed within the interior of the toe comprising an upper wedge for engaging the inner edge of each upper plate and a lower wedge for engaging the inner edge of each lower plate, said actuator being movable from an upper position to a lower position wherein movement of the actuator from its upper position to its lower position causes the upper and lower plates to move from their retracted positions to their extended positions.

9. A pile assembly as claimed in claim 8 wherein the inner edges of each of the upper and lower plates comprises a tapered surface which extends downwardly and inwardly.

10. An elongated pile assembly as claimed in claim 8 further comprising means for maintaining each plate in its retracted position during driving of the pile assembly into a soil stratum.

11. An elongated pile assembly as claimed in claim 10 wherein the means for maintaining each plate in its retracted position during driving of the pile assembly into a soil stratum comprises:

at least one deformable retainer bar fixedly attached to the exterior surface of the pile body at a position below each slot, said retainer bar extending upwardly across the exterior opening of the slot to thereby retain the plate within the slot during driving of the pile assembly into a soil stratum.

12. An elongated pile assembly as claimed in claim 11 wherein said retainer bar is deformed when the plate moves from its retracted position to its extended position and wherein in its deformed state, said retainer bar, exerts an upward pressure on the plate to maintain the plate against the upper edge of the exterior opening of the slot.

13. An elongated pile assembly as claimed in claim 8 wherein the outer edge of each plate comprises a tapered edge for urging the plate upwardly when the plate moves through a soil stratum from its retracted position to its extended position.

14. An elongated pile assembly as claimed in claim 8 wherein the lower slots extend in a first direction and the upper slots extend in the second direction normal to the first direction.

* * * * *